United States Patent [19]

Miller

[11] Patent Number: 4,632,439

[45] Date of Patent: Dec. 30, 1986

[54] DOOR LATCHING APPARATUS

[75] Inventor: Cardell E. Miller, Hudson, Wis.

[73] Assignee: Ideal Security Hardware Corporation, St. Paul, Minn.

[21] Appl. No.: 683,176

[22] Filed: Dec. 18, 1984

[51] Int. Cl.[4] ..... E05C 1/12

[52] U.S. Cl. ..... 292/166; 70/481; 292/169.17; 292/170; 292/359; 292/DIG. 60

[58] Field of Search ..... 292/166, 170, 359, 337, 292/92, 21, 169.12, 169.14, 169.15, 169.17, 169.18, DIG 60; 70/481, 482, 489

[56] References Cited

U.S. PATENT DOCUMENTS

| | | | |
|---|---|---|---|
| 618,708 | 1/1899 | Merwin | 292/170 |
| 1,207,123 | 12/1916 | Arsneau | 70/482 |
| 1,720,640 | 7/1929 | Wread | 292/169.17 X |
| 2,366,934 | 1/1945 | Schlage | 292/166 X |
| 2,978,267 | 4/1961 | North et al. | 292/359 X |
| 3,147,608 | 9/1964 | Turner et al. | 292/166 X |
| 3,248,141 | 4/1966 | Turner | 292/166 |
| 3,490,803 | 1/1970 | Rollins | 292/170 |
| 3,582,121 | 6/1971 | Rollins | 292/170 |
| 3,765,710 | 10/1973 | Orr | 292/169.17 |

FOREIGN PATENT DOCUMENTS

| | | | |
|---|---|---|---|
| 2006481 | 8/1971 | Fed. Rep. of Germany | 292/170 |

OTHER PUBLICATIONS

Design Patent Application Ser. No. 456,516; filed 01/07/83.

Design Patent Application Ser. No. 456,515; filed 01/07/83.

Design Patent Application Ser. No. 684,615; filed 12/21/84.

*Primary Examiner*—Robert L. Wolfe

*Assistant Examiner*—Russell W. Illich

*Attorney, Agent, or Firm*—Merchant, Gould Smith, Edell Welter & Schmidt

[57] ABSTRACT

A door latch (24) suitable for latching a door (20) to a door frame (22). The door latch (24), in a preferred embodiment, has an adjustable nose bolt (36); is "panic unlatchable"; and can be operated by axial or rotational spindle forces supplied by, for example, a push button (48) or a door knob (120). The latch apparatus (24) preferably includes an adjustable nose bolt (36) which is adjustable in and out relative to the spindle (50). A trunnion (58) interposed between the inside handle (46) and the nose bolt (36) allows for relative adjustment of the nose bolt (36) with respect to the handle (46). In addition, a preferred embodiment of the latch apparatus (24) includes a lock lever (100) which forms a recess (108) suitable for capturing a spindle ear (110) to substantially prevent the spindle from operating the latch apparatus (24) to move the nose bolt (36) from a first position to a second position. Finally, a preferred latch apparatus (24) includes a spindle cam (78) which acts on inclined arms (82) of the handle (46).

1 Claim, 10 Drawing Figures

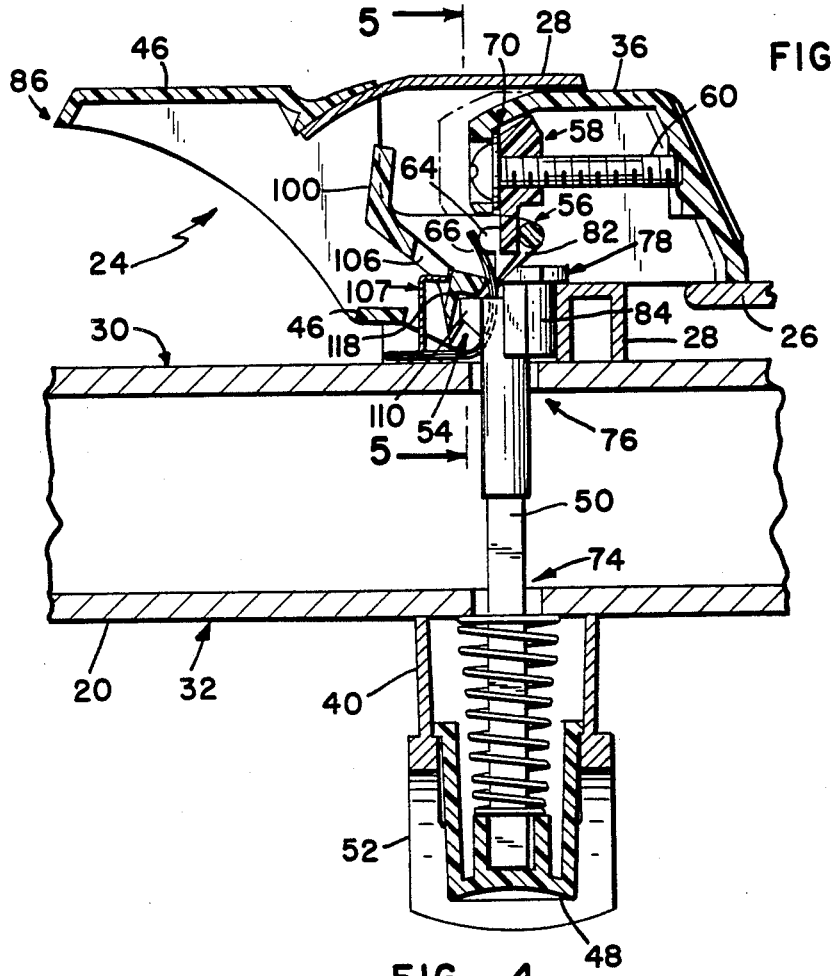
FIG. 3
FIG. 4
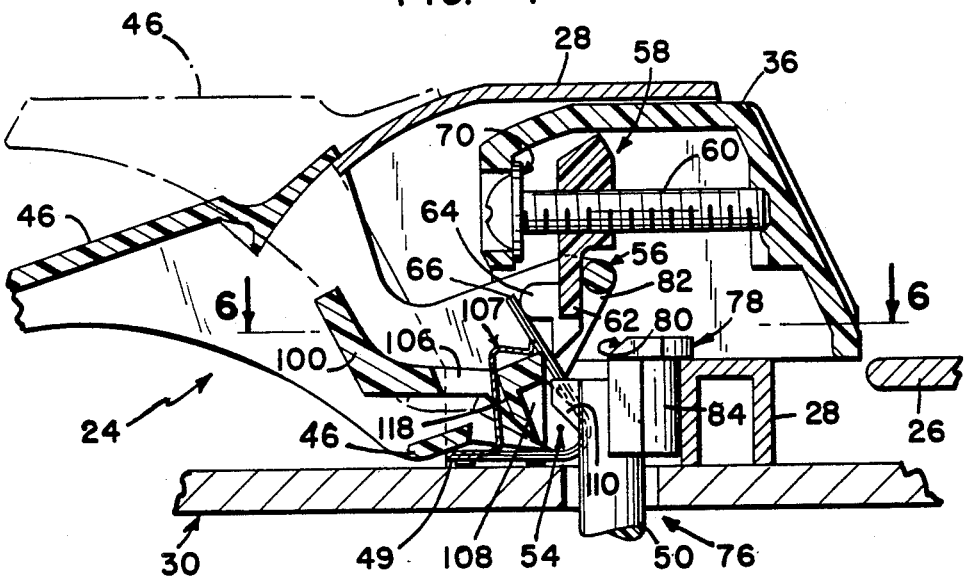

DOOR LATCHING APPARATUS

FIELD OF THE INVENTION

The present invention relates generally to door latches. More particularly, it relates to door latches which are adjustable; which provide for panic unlatching; and/or which accommodate different types of handles.

BACKGROUND OF THE INVENTION

Door latches of various types are well known. Door latches, or catches, serve to hold a door in place when it is closed, even if the door is not locked. Such latches have been used in conjunction with many different types of doors, including primary doors and secondary doors such as screen doors.

The present invention is directed to an improved locking apparatus suitable for doors of any type, but is particularly directed to secondary doors such as screen doors commonly found on residential dwellings.

Actually, a door latch functions to latch or interconnect two door portions which are otherwise relatively movable. The first door portion might be the door itself while the door frame might be the second door portion. Of course, the phrase "first door portion" could also be applied to the frame and the phrase "second door portion" applied to the door.

In order to latch two door portions together, normally a latching apparatus is located on one door portion and a strike is located on the other. The latching apparatus normally includes a movable latching element, such as a "nose" or "bolt," which is suitable for engaging the strike. Typically, a handle, e.g., a knob or lever, is attached to the movable latching element for ease of use.

The strike which engages the movable latching element could be a simply L-shaped bracket or a spring-loaded bar; alternatively, the door frame itself can function as the strike, the latching element engaging the frame, in which case the frame simply has a "strike area" which does not include a specially designed strike.

It should be stressed that the latching apparatus including the movable latching element could be mounted on the door frame while the strike is located on the door, although this is not the normal latching scheme. It should also be noted that the frame of a secondary door may in fact be formed partially or completely by the frame of the associated primary door.

As noted above, the latching apparatus of the present invention is particularly directed, though not limited, to a secondary door such as a screen door for a dwelling. Thus, the present discussion focuses on screen door latches for purposes of illustration, but the scope of the invention is not so focused.

Although prior art screen door latches are well known and generally function adequately for their intended purposes, several problems remain. Some problems stem from the fact that screen doors are used in conjunction with primary doors to seal an opening in the wall of a dwelling. Typically, the screen door is emplaced after the primary door is hung. Thus, the screen door and its frame and latching apparatus must adapt to mechanical constraints associated with the primary door's frame.

More specifically, assuming that the latching apparatus is attached to the screen door and the strike is attached to the screen door's frame, oftentimes the door frame is such that the strike does not extend sufficiently toward the latching apparatus to conveniently allow for engagement of the movable latching element and the strike. Thus, with prior art latching apparatus, the strike usually must be shimmed or the latching apparatus has to be relocated, or both, in order to provide for latching and unlatching of the screen door.

The unadjustability of prior art latching apparatus also creates other problems as well. For example, if the strike is shimmed, it may excessively extend into the doorway, thus creating a nuisance if not a hazard. In addition, it is quite possible that the strike can extend too far even without having been shimmed. In this case, since the prior art locking apparatus cannot be adjusted, the entire latch apparatus (not including the strike) has to be relocated closer to the center line of the door to accommodate the strike.

Similarly, the backset of a latching apparatus might have to be located in a particular position with respect to the edge of the screen door. This would be desirable if it is desirable to vertically align the latching apparatus with an auxiliary piece of hardware such as a deadbolt lock; or, a particular backset might be needed simply to vertically center the latching apparatus in the longitudinal frame piece of the screen door for esthetic reasons.

In such instances, when using prior art latch apparatus, the strike typically has to be shimmed out to engage the movable bolt or nose of the latch apparatus. If the latch apparatus has a particularly long "throw" this shimming process might be unnecessary, but such lock apparatus are typically very cumbersome and complicated.

The unadjustability of prior art latch apparatus becomes particularly troublesome in light of the fact that screen doors, and particularly metal and plastic screen doors, experience thermal expansion and contraction which can fairly significantly change the amount of clearance or interference between the latching apparatus mounted on the door and the strike area or strike located on the door frame. In fact, it might be necessary to shim the strike or relocate the latching apparatus to account for thermal effects.

Prior art screen door latches, in addition to not being adjustable, suffer from another inadequacy. Most prior art door latches include two handles, one handle being located proximate to each surface of the door, i.e., the inner surface and the outer surface. Typically, the latch apparatus includes a lock which is in the nature of a small tab or button which can be slid or rotated to lock the latch thereby preventing unlatching of the door. However, such latching apparatus do not allow for "panic unlatching" of the door wherein the door can be opened simply by engaging the latch handle proximate the inner surface of the door. Absent means for panic unlatching, the individual seeking to exit the door must locate the locking tab and move it appropriately. Since there are no standards or accepted methods for locking such latching apparatus, the individual generally must experiment with the locking apparatus to determine the proper direction for unlocking, unless of course the individual is quite familiar with the particular latching apparatus with which he is dealing.

Lack of a "panic unlatching" means particularly causes problems in panic situations such as when the individual is fleeing a fire or when the individual needs to leave the dwelling rapidly and the doorway is not sufficiently lighted.

In addition to the problems associated with unadjustability and the inability to readily unlatch in a panic situation, prior art latching apparatus do not readily accommodate, without modification, various types of outside door handles. That is, prior art latching apparatus are typically designed to accept only a rotating spindle which is attched to a door knob or handle connected to the outside surface of the door; or the prior art lock apparatus is designed to accommodate only a spindle which moves axially when driven by a push button located on the outside surface of the door. Thus, the lock apparatus manufacturer must supply two types of latch apparatus if he wants to market his product for rotating and push button handles. This means that the manufacturer must assemble and stock two sets of components and is not able to capitalize on all of the potentially available economies of scale.

The present invention is directed to the problems associated with the prior art door latching apparatus. Specifically, the locking apparatus of the present invention is adjustable to accommodate various types and configurations of strikes; it allows for panic unlatching or unlocking of the latch apparatus; and/or it accommodates rotating outside handles and outside handles which apply an axial force on the latch's spindle.

SUMMARY OF THE INVENTION

The present invention is directed to a door latching apparatus which has an adjustable movable latching element; which is panic unlatchable; and/or which is operable in response to axial or rotational spindle forces.

One embodiment of the door latching apparatus of the present invention is suitable for reversibly latching a first door portion having a strike area to a second door portion movable relative to the first door portion. The door latching apparatus includes a movable latching element suitable for engaging the strike area; means for operatively supporting the movable latching element and operatively connecting the movable latching element to the second door portion; means for operatively moving the movable latching element relative to the supporting and connecting means from a first position to a second position, wherein when the door latching apparatus is operatively connected to the second door portion the first position is normally associated with a first latching state of the movable latching element in relation to the strike area, and the second position is normally associated with a second latching state of the movable latching element in relation to the strike area; and means operatively connected to the movable latching element for adjusting the movable latching element to alter the first position of the movable latching element, whereby the first latching state can be made different from the second latching state.

Another embodiment of the door latching apparatus of the present invention is suitable for reversibly latching a screen door having first and second surfaces to a screen door frame having a strike area. The door latching apparatus includes a movable latching element suitable for engaging the strike area; means for operatively supporting the movable latching element and operatively connecting the movable latching element to the screen door; first means suitable for positioning proximate the first screen door surface for operatively moving the movable latching element relative to the supporting and connecting means from a first position to a second position, wherein when the door latching apparatus is operatively connected to the screen door the first position is suitable for latching the screen door to the screen door frame and the second position is suitable for unlatching the screen door from the screen door frame; second means suitable for positioning proximate the second screen door surface for operatively moving the movable latching element from the first position to the second position; and means operatively connected to the supporting and connecting means for selectively substantially preventing movement of the movable latching element upon activation of the second moving means, wherein when the movement preventing means is activated the movable latching element cannot be moved from the first position to the second position by the second moving means but the movable latching element can be moved from the first position to the second position by the first moving means.

A third embodiment of the door latching apparatus of the present invention is suitable for reversibly latching a door having first and second surfaces to a door frame having a strike area. The door latching apparatus includes a movable latching element suitable for engaging the strike area; means for operatively supporting the movable latching element and operatively connecting the movable latching element to the door proximate the door's first surface; first means suitable for positioning proximate the first door surface for operatively moving the movable latching element relative to the supporting and connecting means from a first position to a second position comprising a first handle, wherein when the door latching apparatus is operatively connected to the door the first position is suitable for latching the door to the door frame and the second position is suitable for unlatching the door from the door frame; second means suitable for positioning proximate the second door surface for moving the movable latching element comprising a second handle and a spindle, the second moving means being suitable for transmitting an unlatching force, wherein the spindle is suitable for transmitting axial and rotational unlatching forces in relation to the spindle axis; and means for interconnecting the spindle and the movable latching element, wherein the interconnecting means is responsive to axial and rotational unlatching forces, whereby the movable latching element is movable from the first position to the second position in response to an axial or a rotational spindle force.

Preferred embodiments of latching elements include combinations and subcombinations of adjustable movable latching elements; locking means; and/or means for acting in response to axial and rotational spindle forces.

BRIEF DESCRIPTION OF THE DRAWING

FIG. 3 is a cross sectional view of the latch apparatus of FIG. 1 taken generally along line 3—3 of FIG. 2, illustrating the adjustability of the nose bolt.

FIG. 4 is an enlarged view of a portion of the latching apparatus of FIG. 3 showing an unlatched nose bolt.

DETAILED DESCRIPTION OF THE INVENTION

Figure 1:
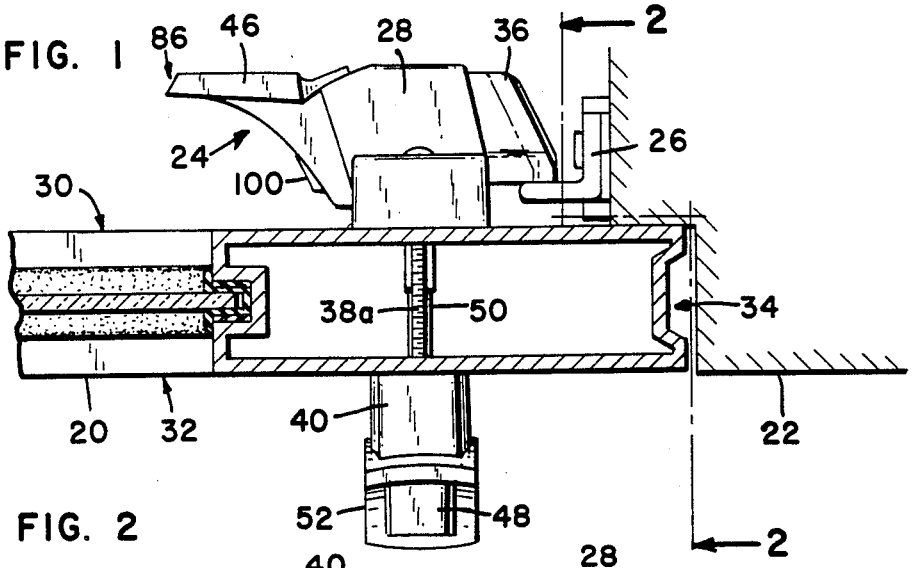
FIG. 1 is a cross sectional view of portions of a door and a door frame, showing a top plan view of an axial embodiment of the latching apparatus of the present invention.

Referring to the drawing, wherein like reference numerals refer to like parts throughout the several views, FIG. 1 shows a cross sectional view of a door 20 and a door frame 22. The door 20 has inside and outside surfaces 30 and 32, respectively, and a longitudinal edge 34 substantially perpendicular to surfaces 30 and 32 and running the length of the door 20. The door 20 also possesses a pair of transverse edges (not shown) at the top and bottom of the door 20 which are typically perpendicular to the longitudinal edge 34.

Mounted to the door 20 is a preferred embodiment of the latch apparatus of the present invention, latch apparatus 24. As is typically the case, latch apparatus 24 is mounted proximate the inside surface 30 and longitudinal edge 34 of the door 20. The latch apparatus 24 preferably includes a movable nose bolt 36 which interacts with a strike 26 to selectively latch and unlatch the door 20 from the door frame 22.

Figure 5:
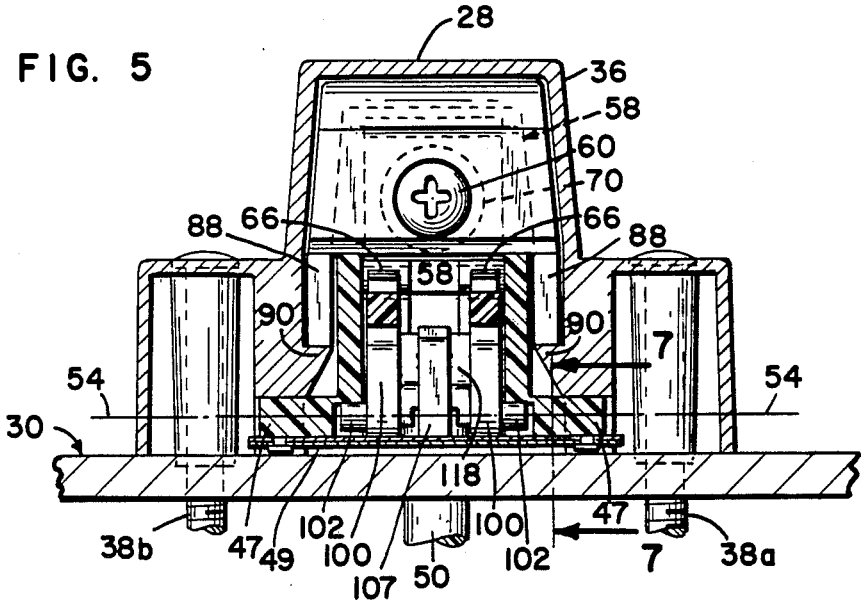
FIG. 5 is a cross sectional view of the latch apparatus of FIG. 1 taken generally along line 5—5 of FIG. 3.

In addition to the nose bolt 36, the latch apparatus 24 preferably includes an inside housing 28 which supports the nose bolt 36 and provides means for mounting the nose bolt 36 to the inside surface 30 of the door 20. Inside housing 28 is preferably made of metal to withstand various forces, and cast zinc has been advantageously applied for this purpose. The inside housing 28 preferably slidably carries nose bolt 36, as shown in FIG. 5.

Figure 2:
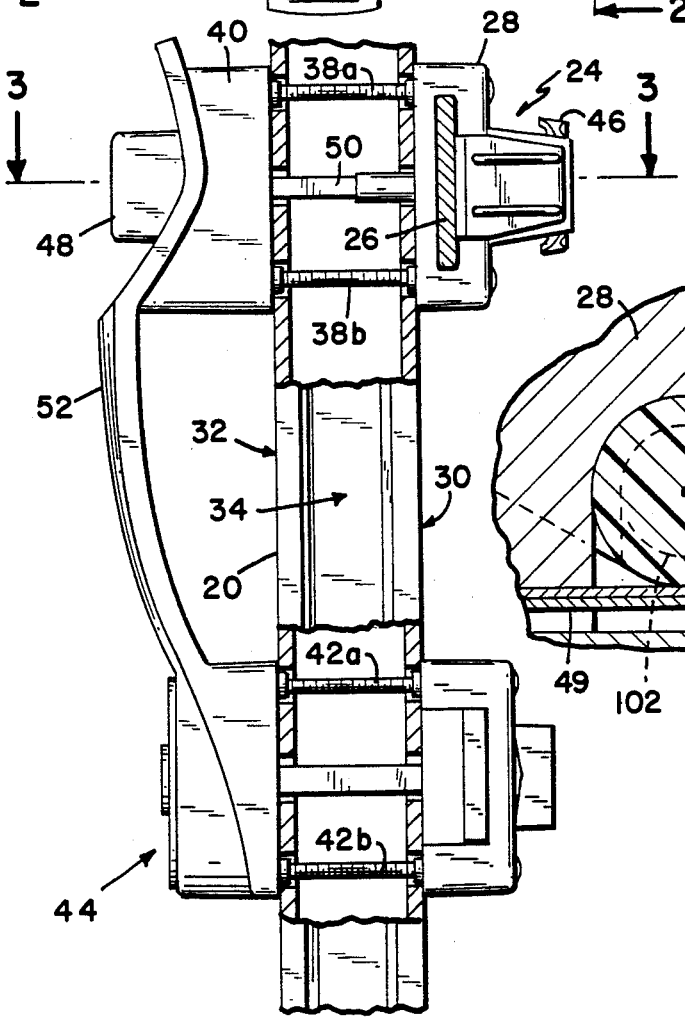
FIG. 2 is a side cross sectional view of the latch apparatus of FIG. 1 taken along line 2—2 of FIG. 1.

As noted above, inside housing 28 mounts to the inside surface 30. In particular, preferably, top retainer screws 38*a* and 38*b* pass through the inside housing 28 and thread into an outside housing 40 which is mounted proximate the outside surface 32 of the door 20. In addition, as shown in FIG. 2, a pair of bottom retainer screws 42*a* and 42*b* preferably serve to hold a dead bolt lock 44 in vertically spaced relation to the latch apparatus 24 of the present invention. It should be stressed that the present invention envisions many different ways of connecting the latch apparatus 24 to the door 20. Also, clearly the latch apparatus of the present invention does not require a lock of any kind, and in particular does not require a dead bolt lock as is shown in FIG. 2, although a dead bolt lock might be desirable in some instances.

The latch apparatus 24 also preferably includes a handle 46 operatively connected to the inside housing 28, the handle 46 enabling the manual activation of the latch apparatus 24. In the preferred embodiment shown in FIG. 1, the handle 46, when depressed, causes the nose bolt 36 to slide away from the longitudinal edge 34 of the door 20 to cause the nose bolt 36 to disengage from the strike 26, thereby unlatching the door frame 20 from the door frame 22 assuming that the nose bolt 36 is properly adjusted.

Still referring to FIGS. 1 and 2 which show a preferred embodiment of the present invention, the outside housing 40 slidably carries a push button 48. Push button 48 is designed to transmit an axial unlatching force to a latch spindle 50 as shown in FIG. 2. Latch spindle 50 then in turn transmits the axial unlatching force to the latch apparatus 24. Then, assuming that the latch apparatus 24 is not locked, the movable nose bolt 36 is caused to slide off of the strike 26 to unlatch the door 20 from the door frame 22, again assuming that the nose bolt 36 is properly adjusted.

Preferably, a door grip 52 is connected to or integral with the outside housing 40 so as to provide a way to pull the door 20 from engagement with the door frame 22. Typically, the door 20 is urged toward the closed position as shown in FIG. 1 by a door closer (not shown). Also preferably housing 40, grip 52 and dead bolt lock 44 are metal since they are typically located on the outer surface of the door.

It should be noted that in the push button embodiment as shown in FIGS. 1 and 2 the push button 48 transmits an axial force through the latch spindle 50 and to the latch apparatus 24. The axial latching force is so named since it is transmitted parallel to the axis of the latch spindle 50. The latch spindle 50, as shown in FIG. 2, is preferably a slender member with its axis running the length of the spindle 50 proximate its center of rotation.

Further with regard to the latch spindle 50, preferably the spindle 50 passes through the inside and outside surfaces 30 and 32, respectively, of the door 20 substantially perpendicular or transverse to the surfaces 30 and 32.

It should also be noted that although inside handle 46 and push button 48 are as shown and described above, clearly the present invention envisions various types of handles, the term "handle" being used herein as meaning any member or element which is operatively coupled to a movable latching element such as the nose bolt 36 as shown in FIG. 1. For example, a latch "handle" could be the handle 46 or the push button 48, or could be a rotary door knob or lever or, in fact, any activating element or member which is operatively coupled to a latching element.

Figure 7:
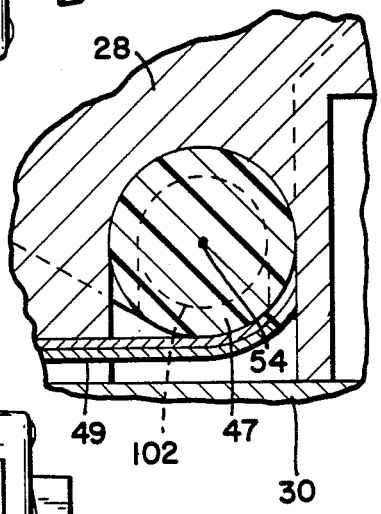
FIG. 7 is an enlarged cross section view of a portion of the latch apparatus shown in FIG. 5 taken generally along line 7—7.

FIG. 3 is a cross sectional view of the latch apparatus of FIG. 1 taken generally along line 3—3 of FIG. 2. As shown, handle 46 preferably includes a driver portion 56 which is preferably a substantially circular rod portion disposed so that its longitudinal axis is substantially parallel to the longitudinal edge 34 of the door 20. The handle 46 also preferably includes a pair of cylindrical bearings 47 which rotate about a pivot axis 54, as shown in FIGS. 5 and 7, the bearings 47 being rotatably carried by the inside housing 28 proximate its base. See, for example, FIG. 10, which shows the base of a preferred latching apparatus 24. Spring 49 acts to hold bearing 47 in sliding rotating contact with the housing 28.

The driver portion 56 of handle 46, is preferably in slidable contact with a trunnion member 58 which actually transmits the unlatching force from the handle 46 to the nose bolt 36. Trunnion member 58 preferably includes a body which forms a threaded hole suitable for receiving an adjustment screw 60. Extending downward from the body of the trunnion 58 is a driven portion 62 which is acted upon by the driver portion 56 of the handle 46, this interaction being clearly shown in FIG. 4. The handle 46 and the trunnion 58 are preferably made from plastic materials that have a very low coefficient of friction between one another since they are preferably slidably engaged.

Figure 10:
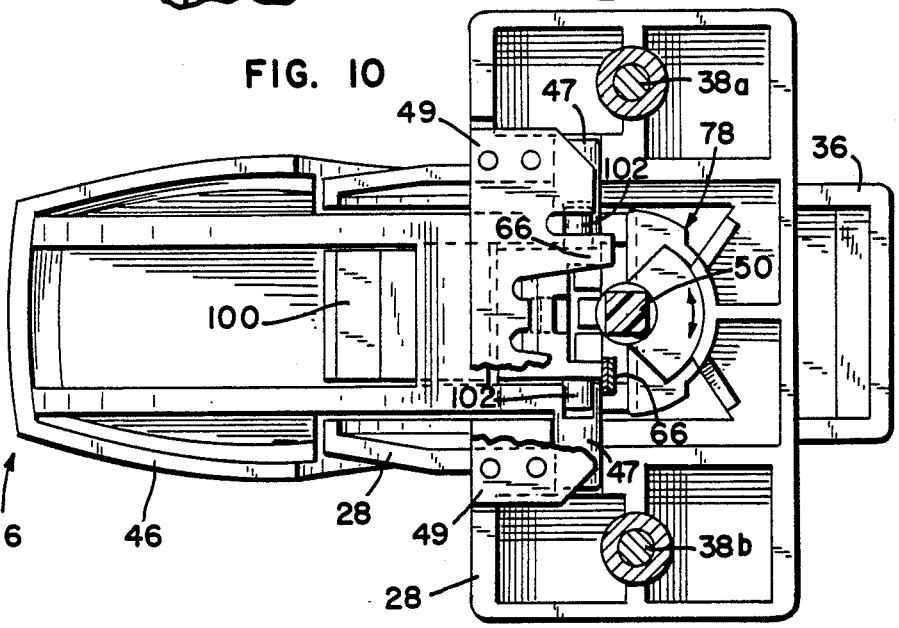
FIG. 10 is a cross sectional view of the rotary embodiment shown in FIGS. 8 and 9, taken generally along line 10—10 of FIG. 8.

It should be noted that the engagement between the driver portion 56 of the handle 46 and the driven portion 62 of the trunnion 58 is preferably on the side of the trunnion proximate the strike 26 rather than on the side of the trunnion 58 proximate the hinges of the door (not shown). Acting on the hinge side of the trunnion 58 on a rounded bearing surface 64 is a trunnion spring member 66. The trunnion spring member 66 is preferably formed from light gauge spring steel and rivetted to the base of inside housing 28 or attached using other well known techniques. FIG. 10 illustrates how the spring 49 is preferably attached to the base of housing 28, a portion of the spring 49 forming a pair of trunnion spring members 66.

As shown in FIGS. 3 and 4, the body of the trunnion threadedly accepts the adjustment screw 60. The adjustment screw 60 is readily accessible from the hinge side of the trunnion 58 when the handle 46 is in its undepressed position as shown in FIG. 3. The adjustment screw 60 is preferably oriented such that its axis is substantially perpendicular to an imaginary plane which is parallel to the longitudinal edge 34 of the door 20. The distal tip 68 of the adjustment screw 60 preferably freewheels in the distal tip of the nose bolt 36 on the strike side of the trunnion 58.

The adjustment screw 60 preferably integrally includes a washer 70 which is situated on the hinge side of the trunnion 58 so as to slidably contact the inner surface of the nose bolt 36. The washer 70 actually is an extension of the head of adjustment screw 60. Thus, briefly, when the handle 46 is depressed it pivots about pivot axis 54 causing driver portion 56 of handle 46 to push against the driven portion 62 of the trunnion 58 which in turn causes washer 70 of adjustment screw 60 to push against the inner surface of the nose bolt 36 thus urging the nose bolt 36 away from the strike 26. Of course, the trunnion spring 66 effectively acts against the unlatching force provided by the handle 46 so as to urge the nose bolt 36 toward the strike 26 so that once the handle 46 is released the latch apparatus 24 returns to its original state with the nose bolt 36 in contact with the strike 26.

Preferably, the nose bolt 36 can also be activated by latch spindle 50. Latch spindle 50 preferably includes a squared end 74 proximate the push button 48 and a rounded end 76 proximate the latch apparatus 24. Further, preferably the rounded end 76 includes at its tip a spindle cam 78. Spindle cam 78 is preferably designed so that an axial or rotational unlatching force transmitted by the exterior handle, e.g., push button 48, and the latch spindle 50 can act on the driver portion 56 of the handle 46 so as to ultimately move the nose bolt from a first position to a second position to unlatch the door 20.

Figure 6:
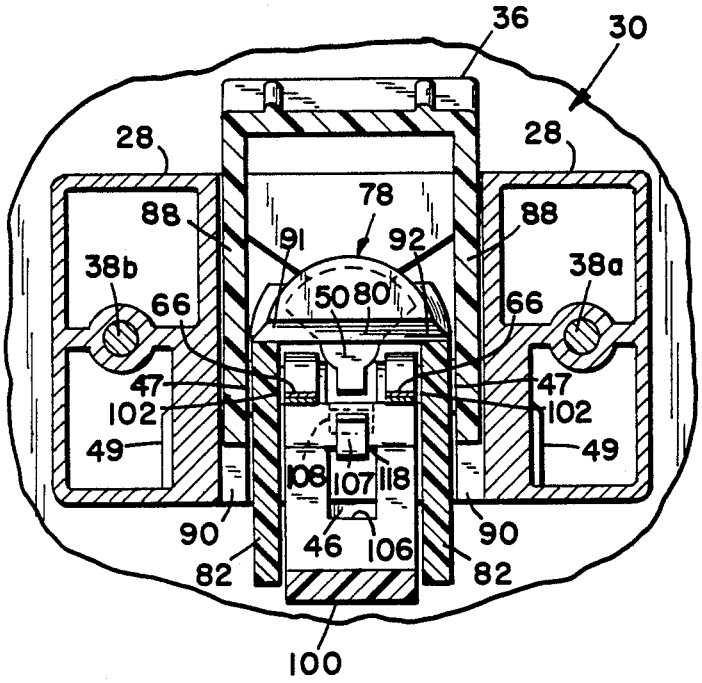
FIG. 6 is a cross sectional view of the latch apparatus of FIG. 1 taken generally along line 6—6 of FIG. 4.

The spindle cam 78 preferably includes a spindle cam inclined surface 80 as shown in FIGS. 4 and 6. Spindle cam inclined surface 80, angling away from the door and toward the strike 26, slidably mates with a pair of inclined arms 82 of the handle 46 which also angle away from the door and toward the strike 26 from the pivot axis 54 of the handle 46 to the driver portion 56. Also, the rounded end 76 of the latch spindle 50 includes an enlarged convex rounded bearing surface 84 which mates with a similarly curved convex surface formed by the inside housing 28. Axial pressure on the latch spindle 50 toward the latch apparatus 24 causes the spindle cam inclined surface 80 to push upwards on the handle inclined arms 82 so that the handle pivots about axis 54 as if someone had pushed on the handle 46 proximate its distal end 86. And, again, the driver portion 56 pushes against driven portion 62 of trunnion 58 so as to push adjustment screw washer 70 against the nose bolt 36 to move it from a first position to a second position to unlatch the door 20, assuming that the nose bolt 36 is properly adjusted.

The nose bolt 36 is preferably slidably supported by the housing 28 as shown in FIG. 5, FIG. 5 being a cross sectional view generally taken along 5—5 of FIG. 3. The nose bolt 36 preferably includes a pair of nose bolt rails 88 which slidably engage a pair of ledges 90 formed by the housing 28. Preferably, the housing 28 is made from metal, e.g., cast zinc, and the nose bolt 36 is made from a plastic material, e.g., nylon or zytel, so that friction is minimized between the two parts.

Again referring to FIG. 3, and again with regard to the spindle cam 78, a preferred design of the spindle 50 and the spindle cam 78 enables the latch apparatus 24 to function regardless of whether the unlatching force transmitted by the spindle 50 is an axial force, i.e., a force parallel to the axis of the spindle, or a rotational force, i.e., a force on the spindle which tends to rotate the spindle about its axis. That is, the preferred spindle 50 will cause the nose bolt 36 to slide from a first position to a second position when the spindle 50 is rotated as well as when the spindle 50 is axially translated.

Figure 8:
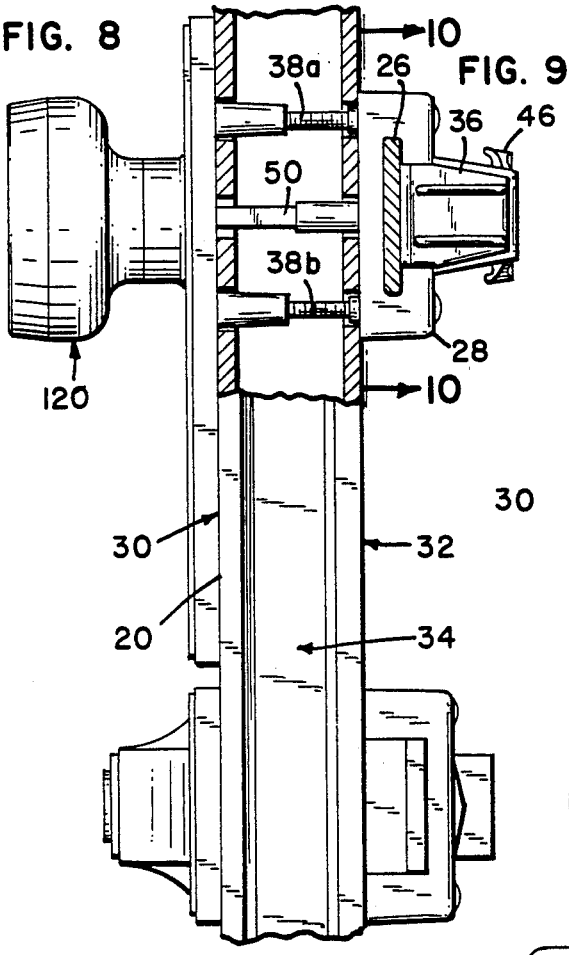
FIG. 8 is a side view of a door which includes a rotary embodiment of the latching apparatus of the present invention, the door being broken away to show a cross sectional view of a portion of the rotary embodiment.
Figure 9:
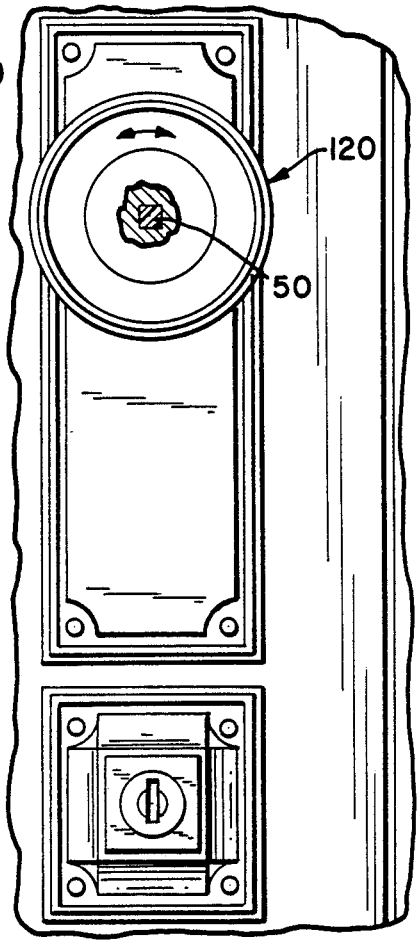
FIG. 9 is a front elevational view of the rotary embodiment shown in FIG. 8, a portion of the door knob being broken away to show the spindle in cross section.

FIG. 8 shows a side view of a door which includes a rotary embodiment of the latching apparatus of the present invention, the door being broken away to show a cross sectional view of a portion of the rotary embodiment. Preferably, the latch apparatus 24 of the rotary embodiment is as shown in FIGS. 3–7. That is, the latch apparatus 24 on the inner surface 30 of the door 20 is preferably the same regardless of the type of handle proximate the outer surface 32 of the door 20. As shown in FIG. 6, the incline surface 80 has a first end 91 and a second end 92 which operatively engage inclined arms 82*a* and 82*b* of the handle 46, respectively. When latch spindle 50 is rotated about its axis one end 91 or 92 of the spindle inclined surface 80 pushes against its corresponding handle inclined arm 82 to cause the handle 46 to pivot about its axis 54 in a counter clockwise direction when the apparatus is viewed as shown in FIG. 3.

It should be noted that when the rotary embodiment as shown in FIG. 8 is employed, rotation of the spindle 50 in either direction will cause the nose bolt to retract. Also, preferably door knob 120 will include its own return spring or springs, but the trunnion springs 66 of the latch apparatus 24 will urge the spindle 50 toward its neutral or initial position as shown in FIG. 10. Thus it is clear why it is preferable to have a squared end 74 of the spindle 50 proximate the outer surface of the door. This allows the use of either push button 48 or door knob 120, depending on the application. In fact, any type of outside handle will function properly, so long as it transmits or provides an axial or a rotational unlatching force to the spindle 50.

A preferred embodiment of the present invention also provides for "panic unlatching." Latch apparatus 24 preferably includes a lock lever 100 which is pivotally connected to the inside housing 28. The lock lever 100 preferably includes a pair of circular bearing cylinders 102 extending from the main body of the lock lever 100, as shown in FIG. 5. The bearing cylinders 102 are preferably coaxially aligned with the bearing cylinders 47 of handle 46 as also shown in FIG. 5.

Lock lever 100 includes a distal portion 104 which is readily accessible below the handle 46. The lock lever 100 also preferably forms an aperture 106 in a portion of the lock lever 100 which is substantially parallel to the door surfaces when the lock lever 100 is in the position as shown in FIG. 4. This aperture 106 is suitable for admitting a lock lever spring 107 as shown in FIGS. 4 and 6. Lock lever spring 107 preferably extends from and is integral with spring 49 connected to the base of housing 28. Also, preferably, proximate to its pivot axis 54 on its underside, lock lever 100 forms a locking chamber 108. The locking chamber 108 is sized to "capture" a spindle ear 110 jutting radially from latch spindle 50 adjacent the tip of the rounded end 76. Locking chamber 108 selectively substantially encloses spindle ear 110 so that the latch spindle 50 cannot be axially translated nor can it be rotated about its axis, thus preventing spindle cam 78 from effectively acting upon handle 46. On the other hand, an unlatching force generated by pushing on distal end 86 of handle 46 will still move the nose bolt 36 from a first position to a second position to unlatch the door 20.

Also, importantly, movement of handle 46 will cause lock lever 100 to rotate about its axis 54 to its inoperative position as shown in FIG. 4 in which case locking chamber 108 does not contain spindle ear 110. Pointed portions 112 of trunnion 58 force lock lever 100 into the inoperative position as shown in FIG. 4 upon movement of the trunnion 58 toward the door's hinges (not shown) in response to sufficient depression of the handle 46.

Lock lever spring 107, operatively connected to the base of latch apparatus 24 and extending through aperture 106 of lock lever 100, gently holds the lock lever 100 in place as shown in FIG. 3. L-shaped lock spring 107 resists movement of the lock lever 100 from an inoperative position as shown in FIG. 4 to an operative position as shown in FIG. 3 by pressing on the top surface 116 of the lock lever 100. Once the resistance of lock spring 107 is overcome, however, lock lever 100 snaps into an operative position as shown in FIG. 3 and the L-shaped lock spring 107 actually gently holds the lock lever 100 in that position by pushing against the inner wall 118 of lock aperture 106, holding the locking chamber 108 over A preferred lock apperatus 24 is also adjustable so that the nose bolt 36 can accommodate strikes 26 having various dimensions and extrusions. Generally, as discussed above, latch apparatus 24 is suitable for moving the nose bolt 36 from a first position to a second position. It is hoped that the first position corresponds to or is associated with a "latched state" wherein the nose bolt 36 and the strike 26 are operatively engaged and the door 20 is latched to the door frame 22. It is also hoped that the second position is associated with an "unlatched state" wherein the nose bolt 36 and the strike 26 are substantially disengaged so that the door 20 is unlatched from the door frame 22. However, in some cases the strike 26 may extend too far or not enough so that the "state" of the latch does not change upon movement of the nose bolt or other movable latching element from the first position to the second position or vice versa. In such instances, it is desirable to adjust the nose bolt 36 so that the "states" of the latching apparatus change depending on the position of the nose bolt 36.

The latching apparatus 24 of the present invention, as noted above, includes a trunnion 58 which threadably accepts an adjustment screw 60. Rotation of adjustment screw 60 about its axis causes relative movement of nose bolt 36 relative to trunnion 58. Thus, for example, as shown in FIG. 3, nose bolt 36 can be adjusted so that its "first position" is as indicated by nose bolt phantom line 116 so that its second position will be as shown in FIG. 4. By so adjusting the nose bolt 36, the first and second positions of the nose bolt 36 correspond to latched and unlatched states, thus making the latch apparatus 24 functional for its intended purpose.

Clearly, the foregoing discussion is only a description of preferred embodiments of the present invention. It should particularly be noted that some door frames do not actually include "strikes" per se. In many cases, the door frame itself functions as the strike, wherein the door frame has a "strike area." Generally, it can be said that a "strike area" is an area which is designed to operatively engage a movable latching element and may include a specially designed strike but on the other hand may in some instances simply utilize the door frame itself as the strike.

Also, the drawing shows a "floating nose bolt" wherein the nose bolt or nose is spring loaded toward its latched position. Clearly, as well known to those skilled in the art, the nose might be made so that it does not float but instead the strike might include a spring-loaded pin or bar so that it snaps out of the way as it is engaged by the bolt upon the door's closing.

It should be emphasized the present invention is not limited to any particular materials or combination of materials, and modifications of the invention will be apparent to those skilled in the art in light of the foregoing description. This description is intended to provide specific examples of individual embodiments which clearly disclose the present invention. Accordingly, the invention is not limited to these embodiments or to the use of elements having these specific configurations and shapes as presented herein. All alternative modifications and variations of the present invention which fall within the spirit and broad scope of the appended claims are included.

I claim:

1. A door latching apparatus for reversibly latching a screen door having a first surface, a second surface and a longitudinal edge to a screen door frame having a strike, comprising:

(a) a slidable nose bolt suitable for engaging the strike;

(b) a first housing suitable for operatively connecting to the screen door on the screen door's first surface proximate the door's longitudinal edge and configured to slidably support said nose bolt;

(c) a first handle operatively connected to said first housing for sliding said nose bolt from a first position to a second position, wherein when said door latching apparatus is connected to the door said first position is normally associated with a latched state and said second position is normally associated with an unlatched state;

(d) an adjustment trunnion in operative contact with said first handle;

(e) an adjustment screw having a screw axis threadedly engaged with said adjustment trunnion and operatively engaged with said nose bolt, wherein rotation of said adjustment screw about said screw axis alters said first and second positions of said nose bolt so that said nose bolt is operatively engaged with the strike when it is in said first position and said nose bolt is operatively disengaged from said strike when said nose bolt is in said second position;

(f) a second housing suitable for operatively connecting to the screen door on the door's second surface proximate the door's longitudinal edge;

(g) a second handle operatively connected to said second housing proximate the second surface of the door;

(h) a spindle having first and second ends and a spindle axis, said first end of said spindle including a cam surface and a spindle ear, said cam surface being operatively disposed relative to said first handle, wherein said second handle and said spindle are suitable for transmitting axial and rotational unlatching forces in relation to said spindle axis, wherein said cam surface of said first end of said spindle is configured to operatively act on said first handle in response to axial or rotational unlatching forces; and (i) a lock lever having a locked position and an unlocked position operatively connected to said first housing, said lock lever forming a recess suitable for capturing said spindle ear to substantially prevent axial or rotational movement of said spindle, wherein said lock lever is movable to said unlocked position upon movement of said first handle.

* * * * *